United States Patent [19]

Schuster

[11] Patent Number: 4,883,002

[45] Date of Patent: Nov. 28, 1989

[54] FURNACE CLOSING MECHANISM FOR INDUSTRIAL FURNACES

[75] Inventor: Rolf Schuster, Hanau, Fed. Rep. of Germany

[73] Assignee: Degussa Aktiengesellschaft, Frankfurt, Fed. Rep. of Germany

[21] Appl. No.: 261,403

[22] Filed: Oct. 24, 1988

[30] Foreign Application Priority Data

Oct. 31, 1987 [DE] Fed. Rep. of Germany ... 8714544[U]

[51] Int. Cl.[4] ..... F23M 7/00

[52] U.S. Cl. ..... 110/173 R; 126/190; 220/325; 220/326; 432/250

[58] Field of Search ..... 110/173 R, 176, 177, 110/180, 181, 172; 126/190, 192, 194; 220/318, 326, 325; 432/250

[56] References Cited

U.S. PATENT DOCUMENTS

| | | | |
|---|---|---|---|
| 2,953,998 | 9/1960 | Pew | 110/173 R |
| 3,990,950 | 11/1976 | Carr | 110/173 R |
| 4,121,383 | 10/1978 | Holmes et al. | 220/325 |
| 4,216,062 | 8/1980 | Kelly et al. | 110/173 R |
| 4,295,938 | 10/1981 | Haaf | 110/173 R |
| 4,532,010 | 7/1985 | Dürslen et al. | 110/173 R |
| 4,534,488 | 8/1985 | Boggs et al. | 220/318 |
| 4,552,623 | 11/1985 | Urbye et al. | 110/173 R |
| 4,596,197 | 6/1986 | Kinzler | 110/173 R |
| 4,647,343 | 3/1987 | Stog et al. | 110/173 R |

*Primary Examiner*—Edward G. Favors
*Assistant Examiner*—Denise L. Ferensic
*Attorney, Agent, or Firm*—Beveridge, DeGrandi & Weilacher

[57] ABSTRACT

A furnace closing mechanism for industrial furnaces is composed of a furnace door that can be latched to the furnace shell and a heat-insulating door fastened to the furnace door. This heat-insulating door renders the thermal insulation of the furnace interior gastight. Loss of material caused by friction is prevented by bayonet joints. The heat-insulating door provided by leaf springs and a threaded hub is screwed onto a threaded spindle, which is mounted on the furnace door and can be operated from the outside.

4 Claims, 1 Drawing Sheet

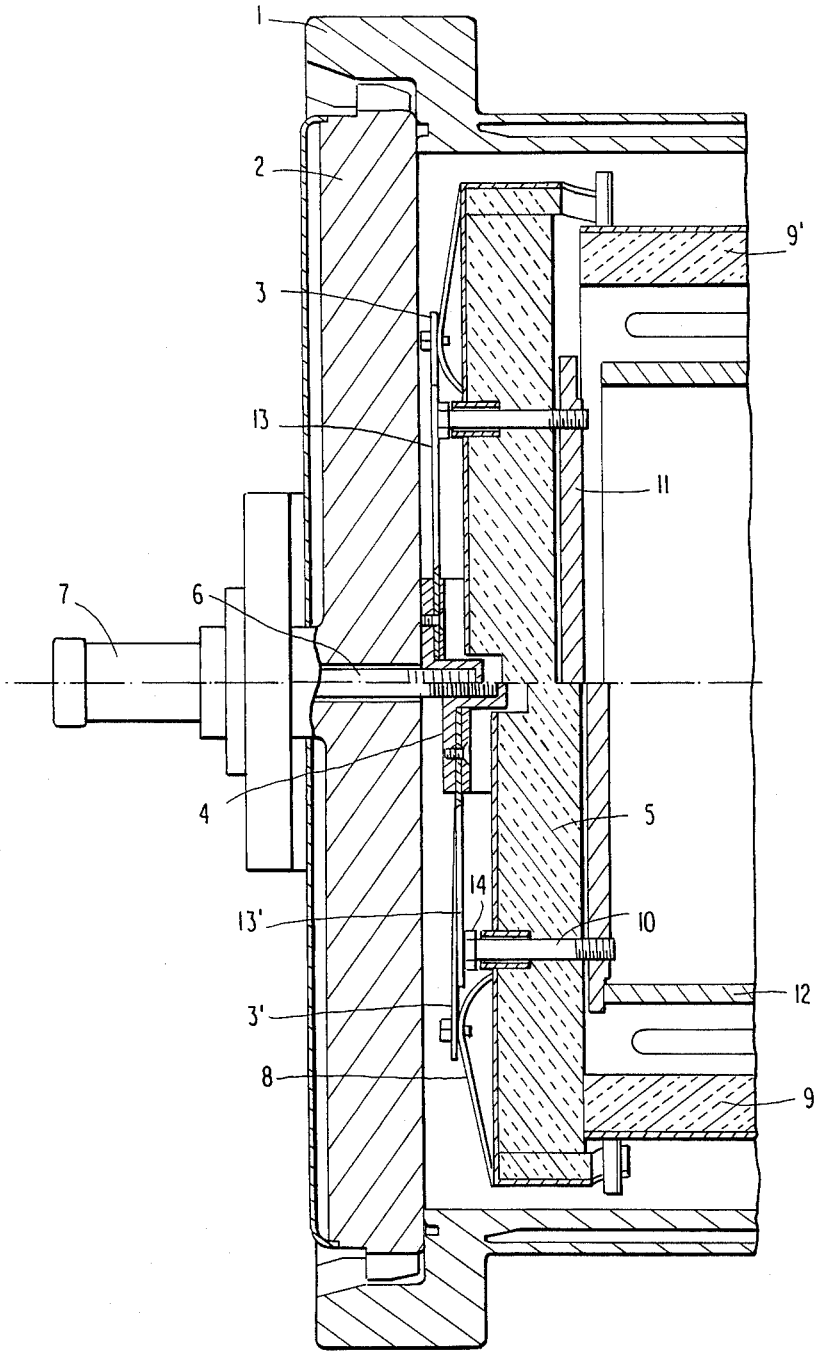
1
2
3
13
7
6
4
13'
3'
8
9'
11
5
14
10
12
9

FURNACE CLOSING MECHANISM FOR INDUSTRIAL FURNACES

INTRODUCTION AND BACKGROUND

The present invention relates to a furnace closing mechanism for industrial furnaces comprising a furnace door that can be latched to the shell of the furnace, and a heating insulating door made of a thermal insulating material and connected to the inner face of the furnace door. This door fits up to and thereby produces a thermal insulation located in the furnace interior gas-tight seal.

Industrial furnaces for heat treatment or gas treatment of workpieces normally are formed of a cylindrical pressure vessel, one side or end of which is equipped with a furnace door through which the workpieces are charged into and discharged from the interior of the furnace. Inside the furnace is the heated charging chamber, which is shielded on the outside by a thermal insulation. The chamber is usually in the form of a cylindrical pipe or tubular shaped chamber provided with covers and made of graphite felt or graphite laminate. One of these covers of the chamber must also be removable to allow charging to the chamber and discharging from the chamber as well as gas circulation in the furnace during operation.

In vacuum chamber furnaces, particularly in high-pressure chamber furnaces exposed to high gas pressures both in the heating and cooling cycles, the insulating cover must be particularly tight in order to avoid buoyancy currents in the gas between the hearing chamber and the cold furnace shell.

The furnace closing mechanism normally includes a furnace door adapted to be fitted to the furnace shell and a heat-insulating door attached on the inner side of the furnace door and which insulating door renders the thermal insulation of the furnace gastight. Normally, the closing is effected by means of a bayonet joint or closure, so that the furnace closing mechanism must be rotated 15 to 30 degrees when the furnace is opened or closed. Since in the opening and closing operation the heat-insulating door is pressed against the thermal insulation, loss of insulating material in the sealing joint due to friction occurs every time the furnace is opened or closed. As a result, the thermal insulation of the furnace tends to deteriorate and develop leaks after a certain time and must be repaired.

As a rule, high-pressure sinter furnaces have within the thermal insulation a graphite muffle which must also be sealed with a cover.

SUMMARY OF THE INVENTION

An object of the present invention is to provide a furnace closing mechanism for industrial furnaces including a furnace door latchable to the furnace shell and equipped with a heat-insulating door connected to the inner face of the furnace door. This heat-insulating door is made of a thermal insulating material, so that it makes the thermal insulation of the furnace interior gastight without causing noticeable frictional abrasion between the heat-insulating door and the thermal insulation when the furnace is opened or closed.

In accordance with a feature of the invention, a plurality of leaf springs are fastened to the outer face of the heat-insulting door, on the outer boundary between the heat-insulating door and the furnace door. These leaf springs converge concentrically into a central threaded hub and by screwing the latter onto a threaded spindle attach to the center of the inner face of the furnace door.

Advantageously, the threaded spindle can be operated from outside the furnace.

In high-pressure sinter furnaces with a graphite muffle, it has been found to be also advantageous to fasten the interior muffle door to the heat-insulating door by means of springs. To this end, the interior muffle door is fastened to the inner face of the heat-insulating door by means of axially sliding guide pins that penetrate through the heat insulating door. In order to press tightly against the interior furnace muffle, the heads of the guide pins are in contact with leaf springs that are also attached to the central threaded hub.

By adjusting the position of the threaded hub on the threaded spindle, the distance between furnace door and heat-insulting door or interior muffle door can be adjusted in such a way that in the bayonet joint no friction occurs between heat-insulating door and thermal insulation or between interior muffle door and interior muffle when the furnace door is closed, so that no material is lost. Loss of insulating material caused by friction can be avoided or minimized even more successfully if the heat-insulating door is sealed shut after the furnace door has been closed by actuating the threaded spindle from the outside. The coupling pressure can be set to the desired value by proper selection of the number and spring properties of the leaf springs. They may be made of spring steel or carbon reinforced with graphite fibers. The yieldable biasing of the heat-insulating door or of the interior muffle door has the additional advantage that thermal expansions are easily compensated.

BRIEF DESCRIPTION OF THE INVENTION

The FIGURE shows schematically a longitudinal split section through one embodiment of a furnace closing mechanism of the present invention given by way of example, in which the upper half portion of the drawing shows the furnace closing mechanism with the heat-insulating door open, and the lower half portion of the figure shows the furnace closing mechanism with tightly shut heat-insulting door and interior muffle.

DETAILED DESCRIPTION OF THE INVENTION

Described in further detail, the furnace of the invention includes a shell of typical construction (1) fitted and closed by a furnace door (2). Located within the furnace shell is a heat-insulating door (5) attached or connected to the furnace door (2) by means of a plurality of leaf springs (3,3') and a central internally threaded hub (4). This threaded hub (4) is screwed onto the threaded spindle (6) located and passing through the furnace door (2) so that it can be operated from the outside by means of an actuating mechanism (7). The leaf springs (3,3') are fastened on brackets (8) on the outer rim of the heat-insulating door (5). Depending on the position of the threaded hub (4) on the threaded spindle (6), the leaf springs (3) press the heat-insulating door (5) against the thermal insulation (9,9') of the furnace, thereby sealing the furnace interior in a gastight manner. The interior muffle chamber door (11) is fastened by guide pins (10) to the heat-insulating door (5), thereby making the interior muffle chamber (12) gastight. The locking of the inner muffle door (11) by pressure occurs by means of additional leaf springs (13,13'), which are in contact with heads (14) of the guide pins (10). These additional leaf springs (13,13') also are connected to the hub (4).

The coupling pressure of the heat-insulating door is readily adjusted simply by turning the threaded hub (4) on the threaded spindle (6) to one side or the other. During the cooling cycle of the furnace, the heat-insulating door (5) is lifted from the thermal insulation (9) by means of the actuating mechanism (7). At least two leaf springs (3,3') are used. Three or more can also be used.

Further variations and modifications of the invention will become apparent to those skilled in the art from a reading of the foregoing description and are intended to be encompassed by the claims appended hereto.

German priority application No. G 87 14 544 is relied on and incorporated by reference.

I claim:

1. A furnace closing mechanism for attachment to industrial furnaces having a furnace shell and thermal insulation on the furnace interim, said closing mechanism comprising a furnace door that can be latched to the furnace shell and having an inner and an outer face, a heat-insulating door made of a thermal insulating material and attached to the inner face of the furnace door, which heat-insulating door seals in gastight manner with the thermal insulating of the furnace interior, the outer face of the heat-insulating door (5), having in contact therewith on the outer boundary, a plurality of leaf springs (3,3') that are attached to and converge concentrically with a central threaded hub (4), the threaded hub being screwed onto a threaded spindle (6) attached to the inner face of the furnace door (2).

2. The furnace closing mechanism according to claim 1, wherein the threaded spindle (6) can be operated by means of an actuating mechanism (7) from outside the furnace.

3. The furnace closing mechanism according to claim 1 wherein the inner face of the heat-insulating door (5) there is mounted by means of axially sliding guide pins (10) penetrating through the heat-insulating door (5) an inner muffle door (11), the heads (14) of the guide pins (10) being in contact with leaf springs (13) that are also attached to the threaded hub (4) in order to press tightly against an interior muffle (12).

4. An industrial furnace comprising a furnace shell, thermal insulation located inside said shell, a furnace door that can be latched to the furnace shell and a heat-insulating door made of a thermal insulating material and attached to the inner face of the furnace door, which heat-insulating door seals in gastight manner with the thermal insulation of the furnace interior, the outer face of the heat-insulating door seals in gastight manner with the thermal insulation of the furnace interior, the outer face of the heat-insulating door (5), having in contact therewith on the outer boundary, a plurality of leaf springs (3,3') that are attached to and converge concentrically with a central threaded hub (4), the threaded hub (4) being screwed onto a threaded spindle (6) attached to the inner face of the furnace door (2).

* * * * *